US008266936B2

(12) United States Patent
Box et al.

(10) Patent No.: US 8,266,936 B2
(45) Date of Patent: Sep. 18, 2012

(54) LOCK-ACTUATING KEY WITH IMPROVED IMPACT RESISTANCE

(75) Inventors: Benoit Box, Parmain (FR); Benoit Regnard, Plaisir (FR); Thierry Acas, Fresne Leguillon (FR); Jean-Michel Rieu, Sartrouville (FR)

(73) Assignee: Johnson Controls Technology Company, Holland, MI (US)

( * ) Notice: Subject to any disclaimer, the term of this patent is extended or adjusted under 35 U.S.C. 154(b) by 46 days.

(21) Appl. No.: 12/670,960

(22) PCT Filed: Jul. 21, 2008

(86) PCT No.: PCT/EP2008/005942

§ 371 (c)(1), (2), (4) Date: Apr. 15, 2010

(87) PCT Pub. No.: WO2009/015794

PCT Pub. Date: Feb. 5, 2009

(65) Prior Publication Data

US 2010/0206028 A1 Aug. 19, 2010

(30) Foreign Application Priority Data

Jul. 27, 2007 (FR) ..... 07 05508

(51) Int. Cl.
*A44B 15/00* (2006.01)

(52) U.S. Cl. ..... 70/408; 70/456 R; 70/459

(58) Field of Classification Search ..... 70/395–397, 70/399, 408, 456 R, 459

See application file for complete search history.

(56) References Cited

U.S. PATENT DOCUMENTS

| | | | | |
|---|---|---|---|---|
| 4,888,970 | A * | 12/1989 | Kinzler et al. | 70/456 R |
| 6,499,326 | B1 * | 12/2002 | Heussner | 70/408 |
| 6,691,539 | B2 * | 2/2004 | Jacob et al. | 70/408 |
| 6,705,141 | B1 * | 3/2004 | Jacob et al. | 70/408 |
| 7,055,352 | B2 * | 6/2006 | Meyerson et al. | 70/456 R |
| 7,370,501 | B2 * | 5/2008 | Miyata et al. | 70/459 |
| 7,726,161 | B2 * | 6/2010 | Canard et al. | 70/456 R |
| 2007/0062229 | A1 * | 3/2007 | Miyata et al. | 70/408 |
| 2011/0030430 | A1 * | 2/2011 | Gueble | 70/396 |

FOREIGN PATENT DOCUMENTS

| | | |
|---|---|---|
| EP | 0985788 | 3/2000 |
| EP | 1526232 | 4/2005 |
| FR | 2816976 | 5/2002 |

* cited by examiner

*Primary Examiner* — Christopher Boswell

(74) *Attorney, Agent, or Firm* — Muncy, Geissler, Olds & Lowe, PLLC

(57) ABSTRACT

A key having one end secured to a yoke mounted between in a casing to turn about a pivot axis between a position in which the key is retracted inside the casing and a position in which the key is extended, and a control pushbutton mounted in a housing of the yoke so as to be constrained to pivot therewith and so as to slide between a position for holding the yoke at least in the retracted position, and a position for releasing the yoke for pivoting, the control pushbutton having at least one stud received in a groove of the housing, the groove including an inlet segment that opens out via a first end in an outer face of the yoke and that opens out via a second end in a terminal segment, forming an angle therewith, the terminal segment extending along the pivot axis.

7 Claims, 3 Drawing Sheets

LOCK-ACTUATING KEY WITH IMPROVED IMPACT RESISTANCE

The present invention relates to a key suitable for use, for example, in actuating motor vehicle locks.

BACKGROUND OF THE INVENTION

There exist keys having one end secured to a yoke that is mounted between first and second cheeks of a casing so as to be capable of pivoting between a retracted position and an extended position about a pivot and a control pushbutton for controlling the pivoting of the key, which pivot and pushbutton are mounted in a bore of the yoke and respectively in a housing in the first cheek and in a housing in the second cheek. The control pushbutton is mounted in the bore to be constrained to pivot with the yoke and to be capable of sliding between a holding position in which it projects from the casing, in which position the pushbutton holds the yoke in the retracted position, and a position for releasing pivoting of the yoke. The pivot is indexed in pivoting within the housing of the first cheek so as to form a member for indexing a spring that is interposed between the pivot and the control pushbutton so as to urge the yoke resiliently towards the extended position and the control pushbutton towards the yoke-holding position.

In such keys, the pivot, the spring, and the control pushbutton are mounted in succession after the yoke has been put into place between the cheeks of the casing. The pivot is indexed as a result of an index projecting from the housing and engaging in a setback in the pivot. Unfortunately, it is found that if the key is subjected to an impact along the pivot axis of the yoke, e.g. because its user lets go of the key and it drops to the ground, then there is a risk of the pivot moving towards the pushbutton and thereby releasing the index from its setback. The spring then causes the pivot to pivot, thereby allow the spring to relax and thus preventing it from performing its function of returning the yoke to the extended position.

OBJECT OF THE INVENTION

An object of the invention is to provide means enabling return of the yoke to the extended position to be made more reliable.

BRIEF DESCRIPTION OF THE INVENTION

To this end, the invention provides a key having one end secured to a yoke that is mounted between first and second cheeks of a casing to pivot between a retracted position and an extended position about a pivot and a control pushbutton for controlling pivoting of the key, which pivot and pushbutton are mounted in a bore of the yoke and respectively in a housing in the first cheek and in a housing in the second cheek, the control pushbutton being constrained to pivot with the yoke and the pivot being indexed in pivoting in the housing in the first cheek to form a member for indexing a spring interposed between the pivot and the control pushbutton to urge the yoke reliently into the extended position and to urge the control pushbutton into a position where it projects from the casing. The pivot includes at least one stud received in a groove of the housing in the first cheek, and a groove is formed over a length in the housing in the second cheek, the grooves of the housings in the first and second cheeks being arranged to open out into ends of a groove in the bore at at least one intermediate position of the yoke.

Thus, the stud of the pivot bears against the yoke and opposes movement of the pivot towards the pushbutton when the yoke is not in the intermediate position. Communication between the grooves in at least one intermediate position enables the pivot to be assembled in the casing and the yoke. For the pivot to lose indexing as a result of an impact, it is now necessary for the impact to take place when the key is in that intermediate position. However, as a general rule, the key is either in the extended position or the retracted position, with the intermediate position being a position that is unstable, so it is not very likely that an impact will move the pivot.

Preferably, the grooves of the housings in the first and second cheeks are arranged to open out into the ends of the grooves in the bore for a plurality of intermediate positions contained in an angular range of the yoke.

The angular range enables assembly of the pivot to be facilitated without excessively increasing the risk of indexing being lost as a result of an impact.

In a particular embodiment, the control pushbutton possesses at least one stud held by the action of the spring in a blind segment of the groove in the bore, the blind segment having an inlet opening out with an angle in the main segment of the groove.

Thus, the groove in the bore also serves to enable the control pushbutton to be assembled. The blind segment receives the stud of the control pushbutton in operation and enables it to slide between its projecting position and a position for releasing pivoting of the yoke.

Other characteristics and advantages of the invention appear on reading the following description of a particular, non-limiting embodiment of the invention.

BRIEF DESCRIPTION OF THE DRAWINGS

Reference is made to the accompanying drawings, in which.

DETAILED DESCRIPTION OF THE INVENTION

Figure 1:
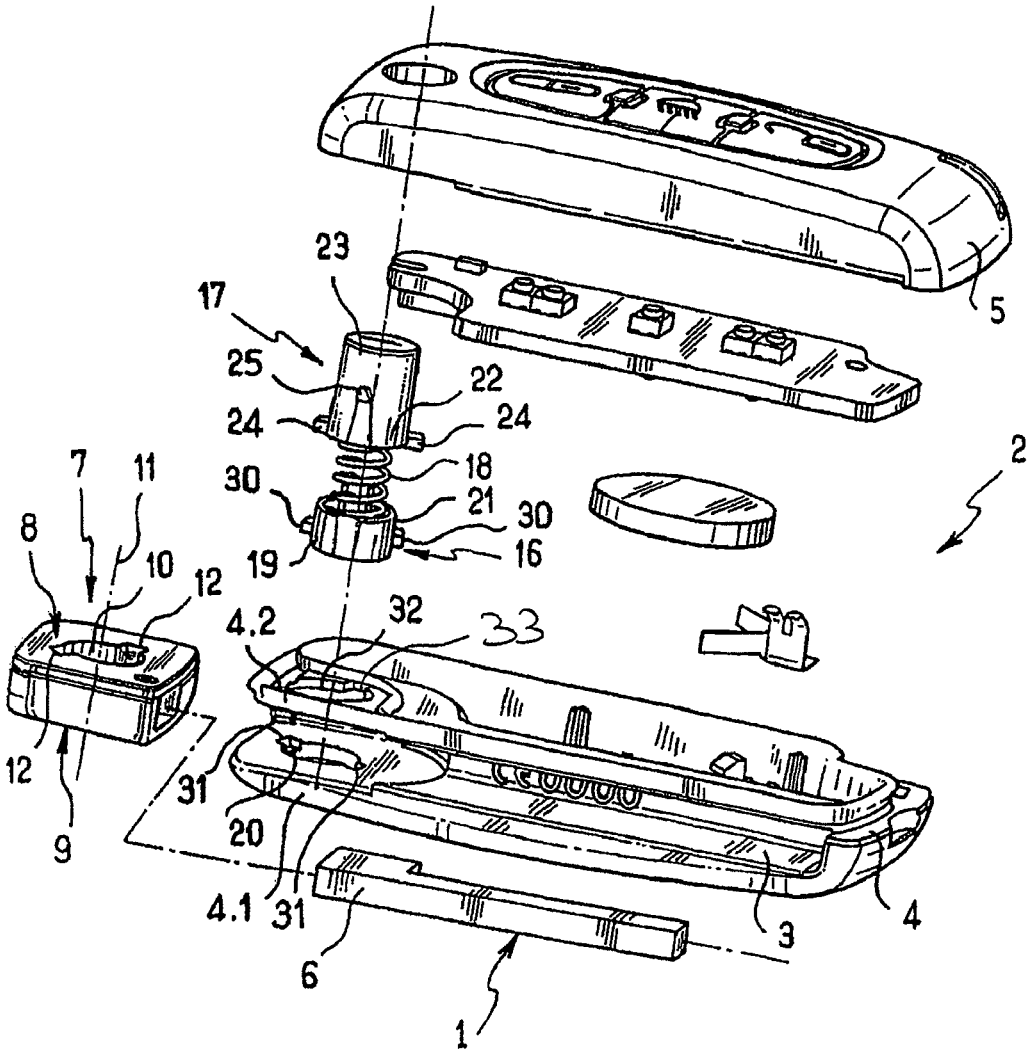
FIG. 1 is an exploded perspective view of a key in accordance with the invention
Figure 2:
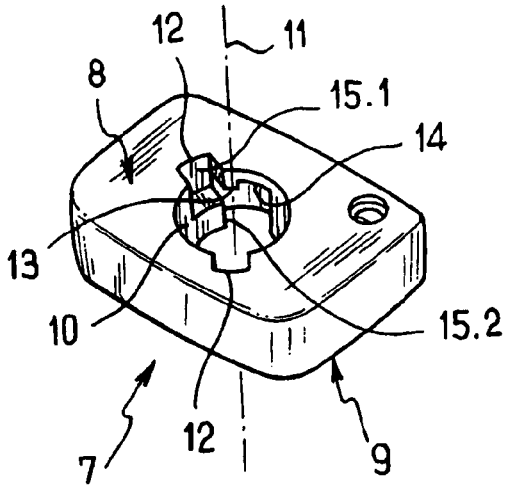
FIGS. 2 and 3 are perspective views of a yoke for mounting the key.
Figure 3:
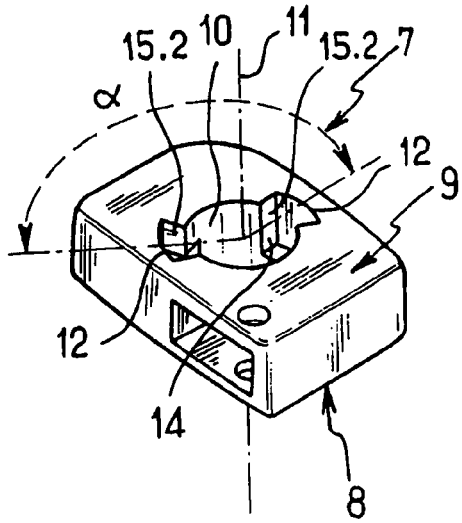
Figure 4:
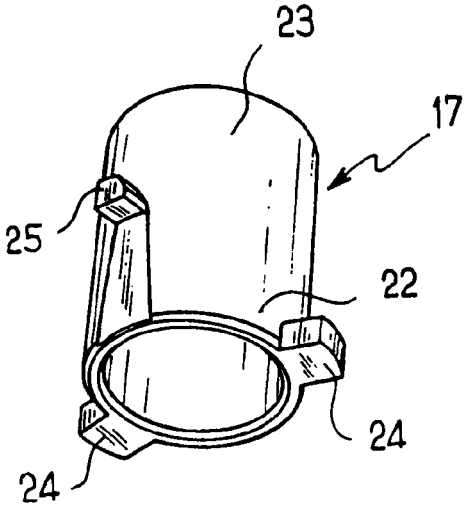
FIG. 4 is a perspective view of a control pushbutton of the key.
Figure 5:
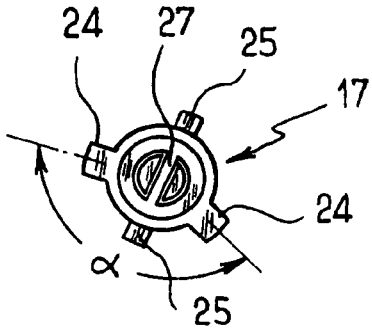
FIG. 5 is a view of the control pushbutton as seen from beneath.
Figure 6:
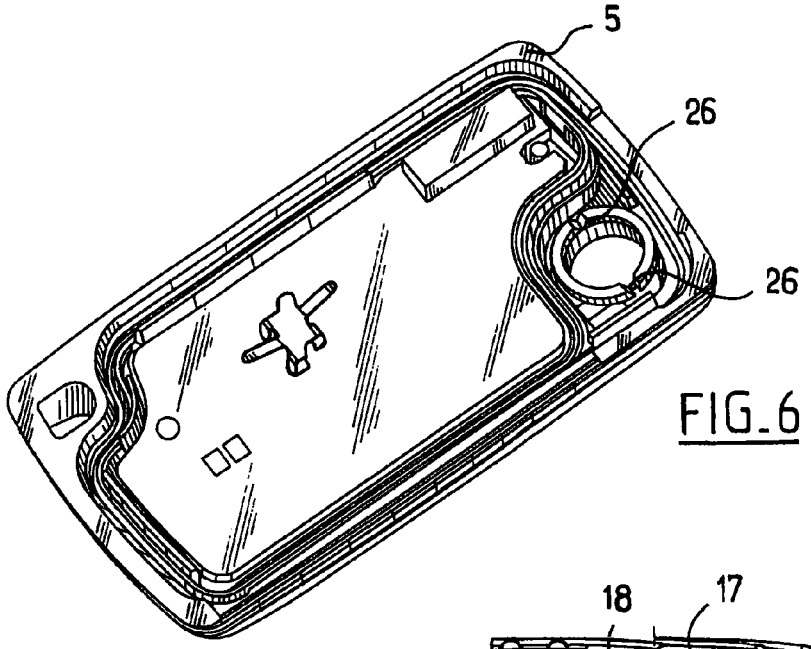
FIG. 6 is a perspective view of a portion of the housing of the key.
Figure 7:
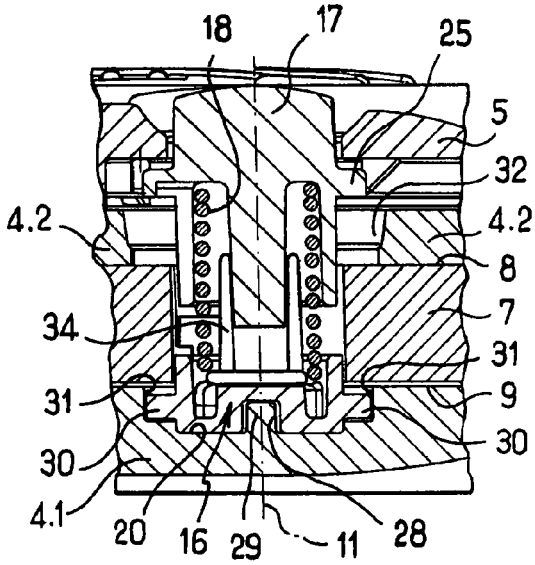
FIGS. 7 and 8 are fragmentary section views of the casing of the key in two angular positions of the yoke.
Figure 8:
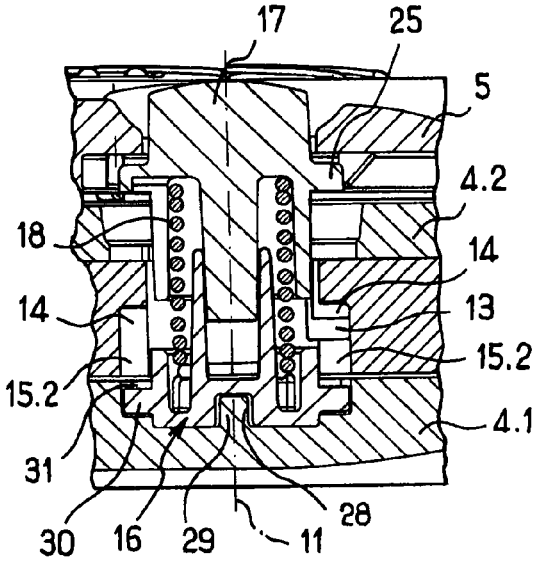
Figure 9:
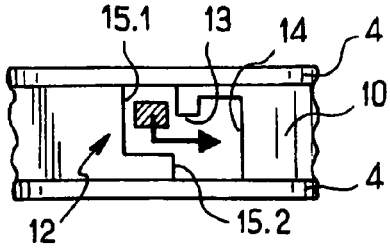
FIG. 9 is a developed view of the groove formed in the bore of the yoke receiving the control pushbutton.

The key in accordance with the invention is described herein as a device for actuating locks such as the locks of a motor vehicle. In particular, the key is suitable for use in locking and unlocking the doors, the trunk, the ignition switch, and the steering column.

The key given overall reference 1 is mounted in a casing 2 to pivot between a position in which it is retracted into a lateral setback 3 of the casing 2 and an extended position in which the key 1 extends at 180° relative to its retracted position. The casing 2 is in the form of a receptacle 4 that is closed by a cover 5 and that contains in this example an electronic remote control module arranged in known manner to actuate remotely a centralized device for locking and unlocking the doors of the motor vehicle.

The key 1 has one end 6 that is fastened in a yoke given overall reference 7 and received between two parallel cheeks 4.1 and 4.2 of the receptacle 4 of the casing 2 that extend at one end of the lateral setback 3.

The yoke 7 possesses two outer faces 8 and 9 that are parallel and opposite from each other. The yoke 7 has a bore 10 with a central axis 11 perpendicular to the longitudinal direction of the key 1 and to the outer faces 8, 9. The bore 10 presents a cross-section that is circular and it opens out in the outer faces 8 and 9.

Grooves 12 are formed in the bore 10 to have ends that open out in the outer faces 8 and 9. The grooves 12 are angularly offset relative to each other by an angle a that is equal to about 170° in this example. This angular offset of less than 180° serves to avoid one of the grooves interfering with the zone of the yoke 7 associated with the end 6 of the key 1, while nevertheless ensuring that the yoke 7 is relatively compact.

Each groove 12 has a main segment 13 that opens out via a terminal segment 15.1 in the outer face 8 of the yoke 7 and via a terminal segment 15.2 in the outer face 9 of the yoke 7. A blind segment 14 opens out into the main segment 13.

The terminal segments 15.1 and 15.2 extend parallel to the central axis 11, and the main segment 13 extends along a circumference of the bore 10. The terminal segment 15.2 is situated behind the terminal segment 15.1 relative to the pivot direction of the key 1 going from its retracted position towards its extended position.

The blind segment 14 extends parallel to the central axis 11 extending the terminal segment 15.2 towards the cheek 4.2 (this makes it easier to make the groove, as explained below).

The bore 10 of the yoke 7 receives a hinge or pivot element given overall reference 16 and a control pushbutton given overall reference 17, with a spring 18 extending therebetween.

The pivot 16 presents an outside shape that is cylindrical with a circular outline, and it possesses an end 19 that is received in a housing 20 in the cheek 4.1 opposite from an end thereof 21 that is pivotally received in the bore 10 of the yoke 7. The end 19 of the pivot 16 and the housing 20 possess indexing portions in relief of complementary shape that prevent the pivot 16 from turning relative to the casing 2. The end 19 thus has an end wall provided with a notch 28 that receives a tongue 29 that projects from the housing 20. In a variant, the end 19 may for example have lateral flats in contact with corresponding plane surfaces of the housing 20, or an off-center indentation that receives a corresponding portion in relief projecting from the cavity 20. The end 21 has an outside shape that is substantially circular and of circular section. Two studs 30 that are angularly offset from each other by the angle α project laterally outwards from the pivot 16 in the vicinity of its end 19 and they are received in grooves 31 that extend axially in the housing 20 and that are angularly offset from each other by the angle α. The studs 30 co-operate with the outer face 9 to form an abutment that opposes extraction of the pivot 16 from the housing 20.

The control pushbutton 17 has a circularly cylindrical outside surface and it possesses an end portion 22 that is received in the bore 10 and an opposite end portion 23 that projects from the bore 10, from a housing 32 in the cheek 4.2, and the cover 5 by passing through an opening therein. Two studs 24 that are angularly offset from each other by 170° project from the end portion 22 and are received in the blind segment 14 of the grooves 12 to slide between a position that blocks pivoting of the yoke 7 and a position that releases the yoke 7 for pivoting. In the blocking position, two studs 25 project from the end portion 23 that is set back from the end face thereof and they are engaged in two notches 26 formed in the vicinity of the opening in the cover 5 of the casing 2 at 180° from each other. In the position for releasing pivoting of the yoke 7, the control pushbutton 17 is pushed in and the studs 25 are disengaged from the notches 26.

The pivot 16 and the control pushbutton 17 define a pivot and hinge axis for the yoke 7 relative to the casing 2. This hinge axis coincides with the central axis 11.

The housing 32 in the cheek 4.2 presents grooves 33 extending axially in the housing 32 at an angular offset angle of α relative to each other. The grooves 31 and 33 of the housings 20 and 32 in the first and second cheeks 4.1 and 4.2 are arranged to open out respectively in the terminal segments 15.1 and 15.2 of the grooves 12 in the bore 10 for a plurality of intermediate positions contained in an angular range of the yoke 7, the angular range being less than about 90° , and being 35° in this example. Since the extended position is at about 180° from the retracted position, the angular range extends from 90° to 125°.

The spring 18 has ends that are prevented from turning in the pivot 16 and in the control pushbutton 17. The pivot 16 and the control pushbutton 17 are provided in this example with respective slots 34 and 27 receiving the corresponding ends of the spring 18 for preventing said ends from turning relative to the pivot and to the control pushbutton, respectively. The spring 18 is a helical spring arranged to work in compression so that it tends to urge the control pushbutton 17 into its blocking position. In addition, when the yoke 7 is in the retracted position, the spring 18 has been subjected to twisting through at least 180° from its rest state. The spring 18 is thus also arranged to work in twisting so as to tend to keep the studs 24 pressed against the flanks 28 of the blind segment 14, and thus to return the yoke 7 into the position in which the key 1 is extended.

It should be observed that in operation the control pushbutton in its blocking position serves equally well to hold the yoke 7 in its position in which the key 1 is extended and in its position in which the key 1 is retracted. If the notches 26 are defined laterally by flanks that are parallel to the sliding direction, it is necessary to push the control pushbutton 17 into its release position in order to bring the key 1 from its extended position to its retracted position, or vice versa. However, if it is desired to be able to bring the key 1 from its extended position to its retraced position without it being necessary to actuate the control pushbutton 17, then it is possible for the flanks of the notches 26 that are beside the retracted position (i.e. the flanks against which the respective studs 25 come into abutment when attempting to return the key 1 from its extended position to its retracted position) to be inclined so as to form a cam whereby sliding against the stud 25 causes the control pushbutton 17 to move into its release position.

When moving the pivot 16 towards the control pushbutton 17, the studs 30 come into abutment against the outer face 9 of the yoke 7, thereby preventing relative disengagement of the tongue 29 out from the notch 28.

The key 1 is assembled in the casing 2 by taking the yoke 7 while fitted with the key 1 , and introducing it between the cheeks 4.1 and 4.2 of the receptacle 4 of the casing 2. Then, while keeping the yoke 7 in an intermediate position in the angular range extending from 90° to 125°, the pivot 16 is placed in the housing 20 and the bore 10, and the control pushbutton 17 is also placed in the bore 10 and the housing 32 with the spring 18 being interposed between the pivot 16 and the control pushbutton 17. It should be observed that it is necessary to cause the pivot 16 or the yoke 7 to pivot so as to bring the studs 30 from the terminal segment 15.1 towards the terminal segment 15.2 by passing through the main segments 13. The studs 24 are inserted in the blind segment 14 by initially causing the control pushbutton 17 to pivot relative to the casing 2 and to the yoke 7 so as to engage the studs 24 in the terminal portions 13.1. The pivot direction is the same as the direction that enables the yoke 7 to go from the extended position to the retracted position: this pivoting must be greater than 180° in order to exert twisting prestress on the spring 18. The control pushbutton 17 is then pushed in so as to bring the control pushbutton 17 into the main segment 13. The spring 18 expands a little in twisting (its twisting must still be 180° relative to its rest state) and brings the studs 24 into the blind segments 14, and it expands in compression so as to return the control pushbutton 17 towards its blocking position.

It should be observed that the control pushbutton 17 can be disassembled by performing the opposite operations.

It should be observed that the terminal segment 15.2 opens out via one end into the outer face 9 and via the other end into the main segment 13, and into the blind segment 14 so as to make the yoke 7 easier to fabricate by molding. When molding the yoke 7, the bore 10 is made by means of two movable cores on a common axis with ends that are brought into contact. One of the cores has tongues projecting outwards to form the terminal segments 15.1, and the other core has tongues projecting outwards to form the terminal segments 15.2 and the blind segments 14. Each main segment 13 is formed at the intersection of the terminal segments and is defined mainly by the end of the terminal segment 15.1 and the opposite flank of the terminal segment 15.2.

Naturally, the invention is not limited to the embodiment described and variant embodiments may be provided without going beyond the ambit of the invention as defined by the claims.

In particular, although the groove is shown as being J-shaped, the groove could be V-shaped, with the inlet segment forming an acute angle with the blind terminal segment.

In addition, the casing 2 may be of a shape other than that shown, for example it could be cylindrical with the retracted and extended positions of the key being offset angularly from each other by an angle other than 180°, e.g. 90° or 120°.

Furthermore, the hinge element may be formed integrally with the casing.

The angular range could be smaller and cover only a single intermediate position.

The pivot 16 could have a single stud only, and the stud(s) may be of various shapes, such as ear-shaped, cylindrical.

What is claimed is:

1. A key having one end secured to a yoke that is mounted between first and second cheeks of a casing to pivot between a retracted position and an extended position about a pivot and a control pushbutton for controlling pivoting of the key, which pivot and pushbutton are mounted in a bore of the yoke and respectively in a housing in the first cheek and in a housing in the second cheek, the control pushbutton being constrained to pivot with the yoke and the pivot being indexed in pivoting in the housing in the first cheek to form a member for indexing a spring interposed between the pivot and the control pushbutton to urge the yoke resiliently into the extended position and to urge the control pushbutton into a position where it projects from the casing, wherein the pivot includes at least one stud received in a first groove of the housing in the first cheek, wherein a second groove is formed over a length in the housing in the second cheek, and wherein the first and second grooves of the housings in the first and second cheeks are arranged to open out into ends of third grooves in the bore at at least one intermediate position of the yoke.

2. The key according to claim 1, wherein the first and second grooves of the housings in the first and second cheeks are arranged to open out into the ends of the third grooves in the bore for a plurality of intermediate positions contained in an angular range of the yoke.

3. The key according to claim 2, wherein the angular range is less than about 90°.

4. The key according to claim 3, wherein the extended position is at about 180° from the retracted position and the angular range extends between 90° and 125°.

5. The key according to claim 1, wherein the control pushbutton possesses at least one stud held by the action of the spring in a blind segment of the third groove in the bore, the blind segment having an inlet opening out with an angle in a main segment of the third groove.

6. The key according to claim 5, wherein the third groove has terminal segments that are substantially parallel to the pivot axis, and the main segment extends in a substantially circumferential direction of the bore, the blind segment extending from the main segment towards the second cheek in a direction that is substantially parallel to the pivot axis.

7. The key according to claim 1, wherein the pivot has two studs and each of the housings and the bore has two third grooves.

* * * * *